US006584942B1

(12) United States Patent
Albertson et al.

(10) Patent No.: US 6,584,942 B1
(45) Date of Patent: Jul. 1, 2003

(54) CYLINDER DEACTIVATION APPARATUS WITH VAPOR PURGE

(75) Inventors: William Conrad Albertson, Clinton Township, MI (US); Frederick J. Rozario, Fenton, MI (US); Vimesh M. Patel, Novi, MI (US); Carlos A. Ponce, Koenigstein (DE)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/157,652

(22) Filed: May 29, 2002

(51) Int. Cl.[7] ..... F01L 1/34

(52) U.S. Cl. ..... 123/90.16; 123/90.15; 123/90.52; 123/90.57; 123/90.12

(58) Field of Search ..... 123/90.12–90.13, 123/90.15–90.16, 90.35, 90.43–90.46, 90.52–90.59; 251/77, 89, 94, 119

(56) References Cited

U.S. PATENT DOCUMENTS 6,481,409 B1 11/2002 Wade et al. ..... 123/198 F 6,513,471 B1 * 2/2003 Hicks ..... 123/90.16

OTHER PUBLICATIONS

Broge, "GM Powertrain Displaces on Demand," *AEI*, Jul. 2001, pp. 41, 42, 44.

* cited by examiner

*Primary Examiner*—Thomas Denion
*Assistant Examiner*—Kyle Riddle
(74) *Attorney, Agent, or Firm*—Leslie C. Hodges

(57) ABSTRACT

Deactivation apparatus for selected cylinders of an engine include switching hydraulic lash adjusters or valve lifters forming part of a valve train for actuating engine valves of the selected cylinders and operable to actuate or release their respective valves in response to an oil pressure signal. A gallery carrying the lash adjusters includes oil passages fed by an engine pressure oil supply through a control valve to supply oil to switching portions of the lash adjusters. The control valve is operative to close or open communication of the oil supply with the lash adjusters and to relieve oil pressure in the passages when communication with the pressure oil supply is closed. Various bypass alternatives between the pressure oil supply and the oil passages carry oil to portions of the oil passages to purge air from the passages when the three-way valve exhaust port is open.

9 Claims, 6 Drawing Sheets

CYLINDER DEACTIVATION APPARATUS WITH VAPOR PURGE

TECHNICAL FIELD

This invention relates to engine cylinder deactivation apparatus and, in particular, to hydraulic lost motion deactivation apparatus incorporating a gas/vapor purge.

BACKGROUND OF THE INVENTION

It is known in the art of engine cylinder deactivation to provide switchable hydraulic lash adjusters operable to either actuate the valves of a deactivation cylinder or to maintain the valves closed through lost motion features of the hydraulic lash adjusters (HLA). Similar mechanisms may be provided in a hydraulic valve lifter (HVL) which includes internally a hydraulic lash adjusting mechanism and so may be referred to broadly as a hydraulic lash adjuster.

Conventional lash adjusters are supplied with pressurized oil through a lash adjuster gallery or lifter gallery to annular feed grooves or intake ports which provide oil pressure to take up the lash in the valve train between the valve and its associated tappet or other-actuator. Lash adjusters and valve lifters with cylinder deactivation have an additional port for a lock pin which connects through control passages and a control channel with a valved oil pressure supply. A three-way solenoid-actuated hydraulic control valve may be used to connect oil pressure to the lock pin for cylinder deactivation or switching of the lash adjusters in a supply mode of the three-way valve and to exhaust oil pressure from the oil passages and control gallery in an exhaust mode.

Such cylinder deactivation apparatus typically use complex systems of bypass channels and hydraulic bleeds in order to purge air or other gas/vapor from the system to insure consistent response to control signals. This is necessary to provide reliable actuation or deactivation of the switchable hydraulic lash adjusters in the apparatus when the hydraulic control valve is actuated to make a change in operation. These bleed and bypass systems may add considerable complexity to the deactivation apparatus itself. Thus, a simplified system for purging gas/vapor, primarily air, from the hydraulic cylinder deactivation apparatus is desired.

SUMMARY OF THE INVENTION

The present invention provides simplified cylinder deactivation apparatus wherein the oil supply passages and control channels utilized for actuating the switchable hydraulic lash adjusters are purged of air with oil flow through restricted bypass means from the pressure oil supply. The control channel or the complete oil passage and control channel system are purged by exhausting the bypass oil flow through a solenoid-actuated hydraulic control valve exhaust port during engine start up and optionally during operation in the non-pressurized mode of the cylinder deactivation apparatus.

In one embodiment, a restricted bypass from the oil pressure supply enters the control channel at a distal end and is exhausted from the control channel through the solenoid valve exhaust port at the other end of the control channel adjacent the control valve. Air or other gas or vapor accumulating in the control channel is thus purged from the system during early stages of the engine operation.

In an alternative embodiment, the pressure oil supply from the lash adjuster gallery to the lash adjuster or valve lifter inlet is connected at each of the switchable lash adjusters with the deactivation port of the respective lifter through a restricted bypass groove in the lifter body. When the deactivation supply pressure is shut off by the hydraulic control valve, pressure oil is fed through the restricted bypass in each lash adjuster body to the gallery passages and control channel of the deactivation apparatus. The oil thus supplied purges the system of air which is exhausted from the system through the open exhaust valve of the three-way hydraulic control valve.

In both cases, when the control valve is actuated to close the exhaust and open the supply line, pressure oil is fed through the control channel and associated passages to the switchable hydraulic lash adjusters at the deactivation ports, thereby switching the lash adjusters to deactivated mode. In this condition, the oil pressure supplied to the deactivation channels and passages balances the pressure supplied to the lash adjuster mechanism itself and thus there is no loss of oil or purge flow through the system. With these arrangements, the purging of air from the control channel and connecting passages is accomplished primarily through the control channel and connecting passages themselves, without the need for additional separate channels and bleed passages that add to the complexity of the system.

In modifications of the two foregoing embodiments, a hydraulic seal is added to the lifter body. An annular channel is provided below the locking pin of each deactivation valve lifter and is supplied with pressurized oil through a vertical channel from the oil gallery. In one case, the annular channel is always below the associated control passage and the oil pressure prevents air from below the lifter gallery from entering the control passage and causing air bubbles that may interfere with the timing of deactivation actuation. In another case, the annular channel is positioned below the control passage on the actuating cam base circle but in alignment with the control passage when the cam raises the lifter to open an engine valve. In the lower position, the seal functions as in the first case above. However, when the lifter is raised cyclically as the cam rotates, oil passes from the oil gallery through the annular channel into the control passage to help flush aerated oil out of the system. Thus, entry of air from below the lifter gallery is prevented and, in the latter case, flushing of air out of the system is aided.

These and other features and advantages of the invention will be more fully understood from the following description of certain specific embodiments of the invention taken together with the accompanying drawings.

DESCRIPTION OF THE PREFERRED EMBODIMENT

Figure 1:
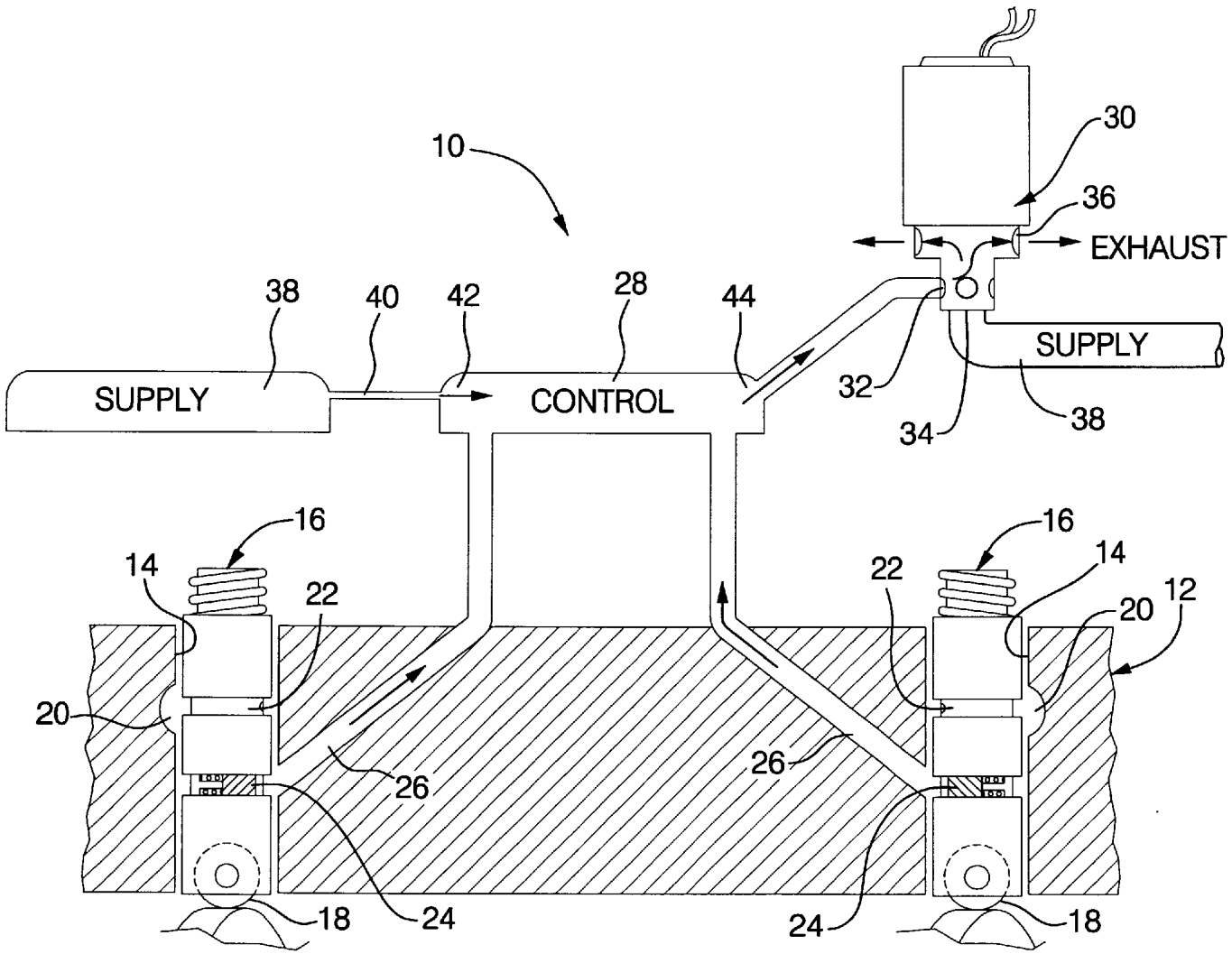
FIG. 1 is a schematic diagram illustrating a first embodiment of cylinder deactivation apparatus utilizing switchable hydraulic valve lifters in a system purged of air by providing bypass oil flow to the control channel when the hydraulic control valve is in the exhaust mode.

Referring first to FIG. 1 of the drawings in detail, numeral 10 generally indicates a first embodiment of cylinder deactivation apparatus including a purge bypass in accordance with the invention. Apparatus 10 includes a lifter gallery 12 having a plurality of through bores 14 containing hydraulic valve lifters 16. Lifters 16 include roller followers 18 that are engaged by a camshaft, not shown, for actuating the lifters in timed relation to engine speed. Each lifter forms part of a valve train, not shown, which is connected to operate one of the valves of an engine cylinder that it is desired to deactivate by holding the cylinder valves closed during certain engine operating conditions. The valve lifters 16 are of a known deactivating or switching type which is actuated by an oil pressure signal to cause the lifter to telescope and allow its valve to remain closed while the engine is running. Upon removal of the oil pressure signal, the valve is again operated in a conventional manner.

The lifter gallery 12 includes a pressure oil supply passage or main gallery 20, a portion of which communicates with annular feed grooves 22 that feed the pressure oil to lash adjusters contained within the valve lifters. Each of the lifters also has a locking pin 24 carried in a pin bore. The pin is exposed to control passages 26 extending in the lifter gallery 12 to a control channel 28 which may be internal or external to the lifter gallery. The control channel communicates with a solenoid-actuated hydraulic control valve 30 having a center port 32 alternately connectable with a supply port 34 and an exhaust port 36. The supply port is connected with the engine main oil supply 38 which also feeds the lifter feed passages 20. The exhaust port 36 returns discharged oil to the engine oil system.

In accordance with the invention, the main oil supply 38 is separately connected to the control channel 28 by a restricted bypass 40. The bypass connects with the control channel 28 through a distal end 42 which is opposite to the feeder end 44 that connects directly with the center port 32 of the control valve.

In operation of the apparatus as described, the control valve 30 is de-energized when the engine is inoperative. The de-energized valve remains in an exhaust position, draining pressure oil from the control channel and locking pins of the associated lifters so that the lifters are placed in their normal operating positions. Upon starting of the engine, pressure is developed in the main oil system 38 and the engine operates normally on all cylinders. A restricted flow of oil is conducted through bypass 40 from the main oil supply 38 to the control channel 28. As the oil passes through the control channel 28, it carries with it air or gas-entrained oil which is purged from the system and carried out through the exhaust port 36 of the control valve.

After a predetermined interval, an engine power control module, not shown, is enabled to operate the solenoid control valve to deactivate selected ones of the engine cylinders having deactivating lifters. This is done only when engine operating conditions call for engine operation on less than all the engine cylinders. Cylinder deactivation is accomplished by opening the control valve 30 to feed pressure oil through the control channel 28 and passages 26 to disconnect the locking pins 24 of the lifters and allow the lifters to telescope within themselves. During deactivation, the valves connected with the deactivated lifters remain closed and the lifter followers oscillate freely without moving the valves from their seats. When conditions calling for all-cylinder operation are present, the solenoid valve is actuated to the exhaust position, removing pressure from the control passages and control channel and allowing the locking pins to reseat. Then the lifters again actuate the valves in their opening and closing motions as driven by the associated cams of the camshaft.

This embodiment of the invention provides purging of entrained air and other vapors and gases from the control channel 28 during start up of the engine and during other times when the lifters are operating normally and oil pressure in the control channel 28 is reduced. However, when the lifters are in the deactivation position, the control channel is pressurized with the same oil feed pressure as the main oil supply 38 so that there is no bypass flow between the supply 38 and the main oil channel.

Figure 3:
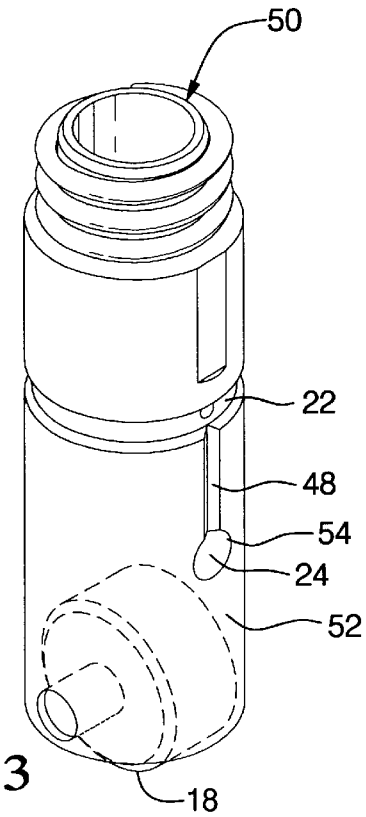
FIG. 3 is an enlarged pictorial view of a switchable hydraulic valve lifter with internal lash adjuster, illustrating the bypass groove arrangement.
Figure 2:
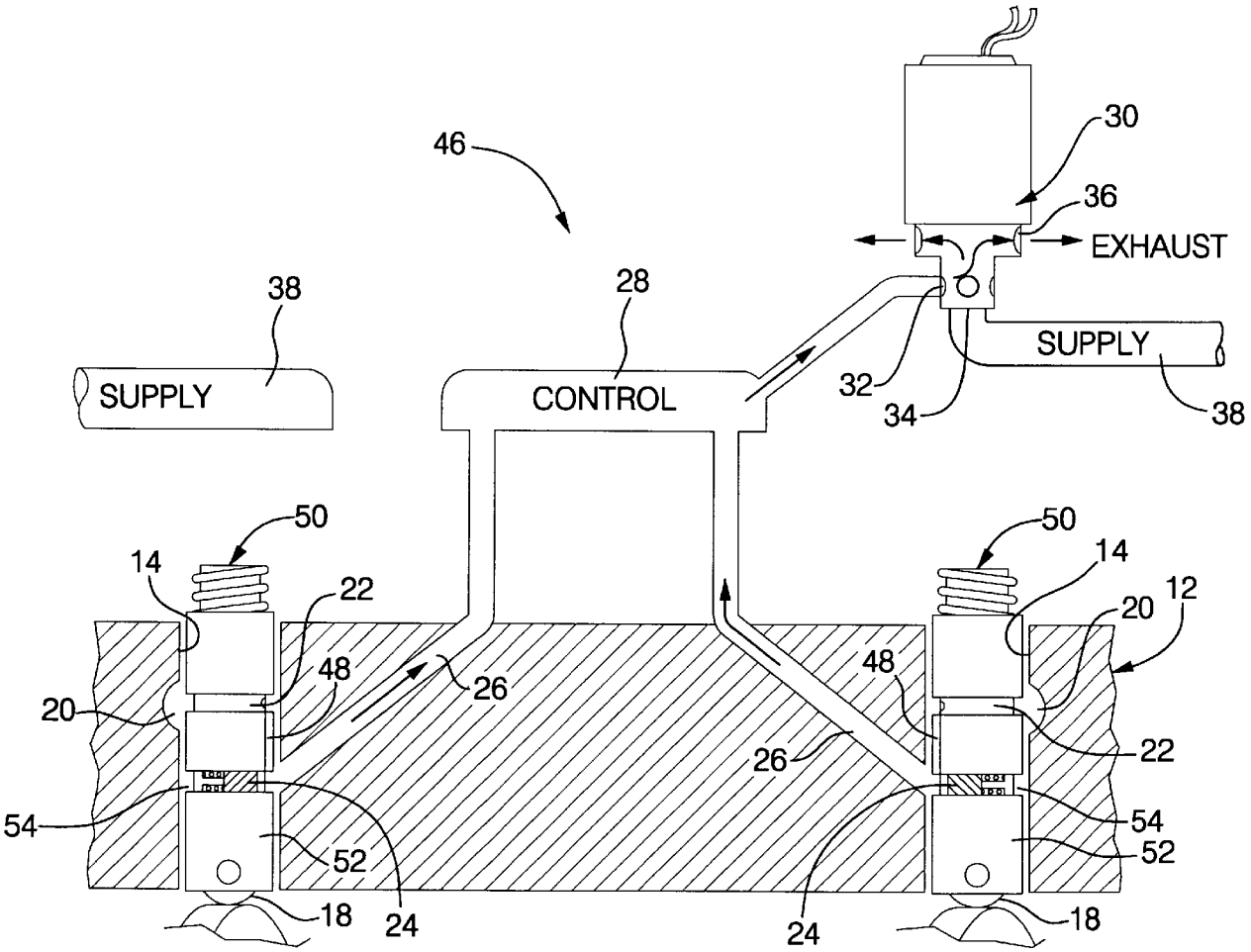
FIG. 2 is a view similar to FIG. 1 wherein the purge oil flow is provided from the lifter gallery pressure oil supply through bypass grooves in the lifter body to the control passages and channel.

Referring now to FIG. 2 of the drawings, numeral 46 generally indicates a second embodiment of cylinder deactivation apparatus. Apparatus 46 is similar in many ways to apparatus 10 previously described so that like numerals are used to indicate like parts. Apparatus 46 differs in that the restricted bypass 40 is omitted. Instead, bypass oil flow is provided through restricted grooves 48 formed in the deactivating or switching lifters 50, which connect the annular feed grooves 22 of the lifter bodies 52 with the locking pin feed openings 54 that communicate with the control passages 26. FIG. 3 shows an enlarged pictorial view illustrating the position of the restricted grooves in the lifters 50.

In operation of embodiment 46 upon engine starting, main oil pressure from the gallery oil passages 20 is provided to the annular feed grooves 22 for actuating the hydraulic lash adjusters in the lifters 50. Simultaneously, a restricted amount of oil flow passes through the bypass grooves 48 of each of the deactivating or switching lifters 50, providing a restricted flow of oil from the pin feed openings 54 through the control passages 26 and control channel 28 back to the control valve 30 which is in the exhaust position. Thus, aerated or vapor-entrained oil in the control passages 26 and channel 28 is purged by the bypass oil flow from the system through the control valve exhaust port 36. Thereafter, the system operates normally. In a supply mode, the control valve 30 supplies pressure oil to the control channel and deactivating pins 24 when it is desired to deactivate the selected engine cylinders. In an exhaust mode, valve 30 exhausts oil pressure from the control channel and passages so that the locking pins are released and again allow normal valve actuation for all the cylinders.

Figure 5:
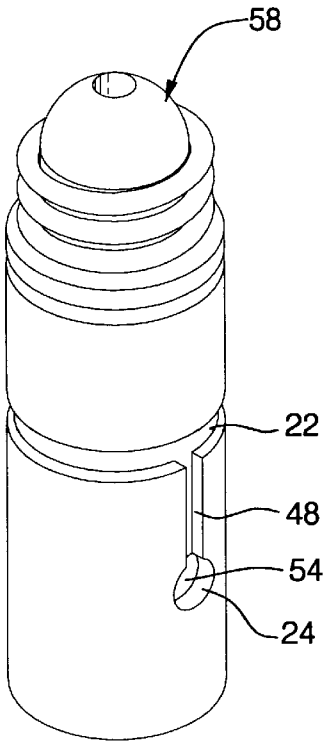
FIG. 5 is an enlarged pictorial view of a stationary hydraulic lash adjuster having a bypass groove according to the invention.
Figure 4:
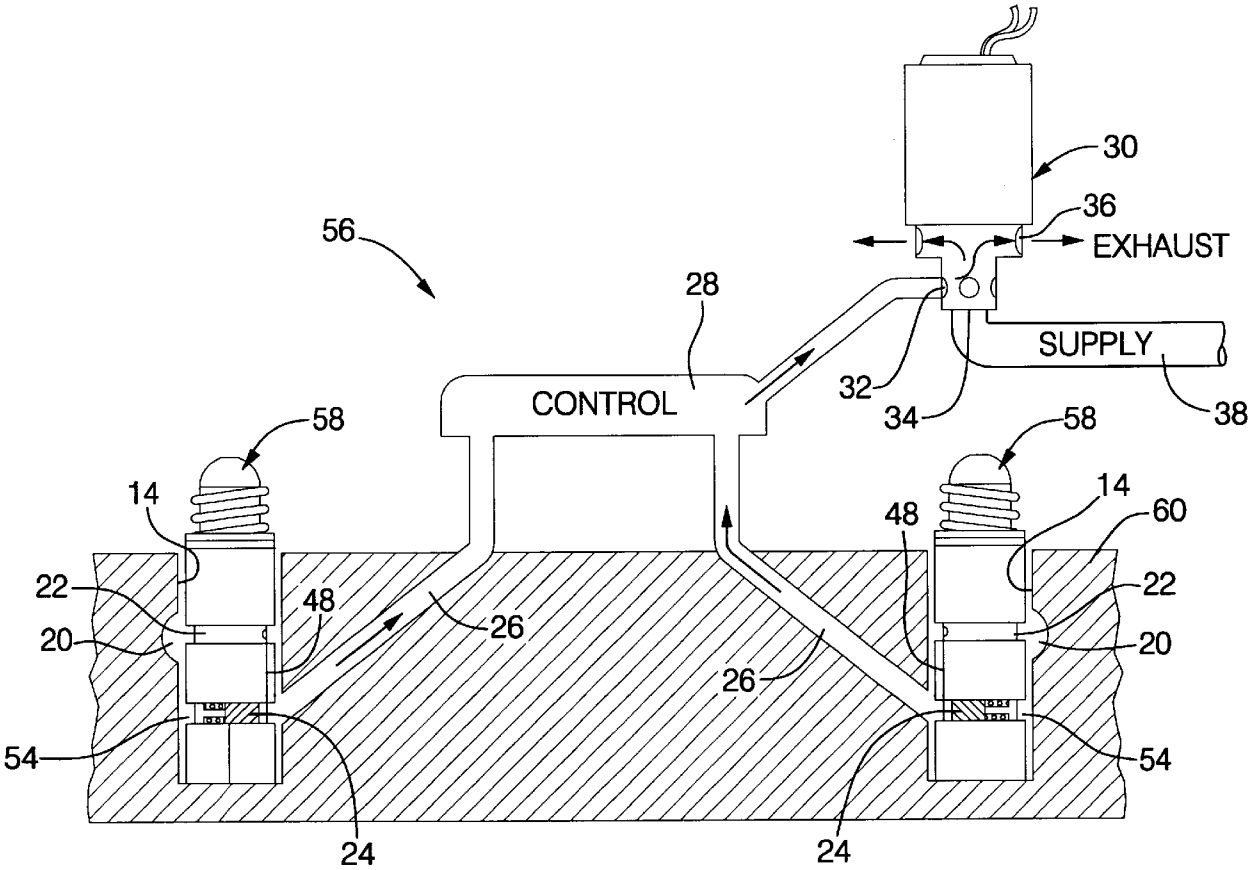
FIG. 4 is a view similar to FIGS. 1 and 2 but showing a third embodiment in which stationary hydraulic lash adjusters are provided with purge oil flow from the gallery pressure oil feed and bypass grooves in the lifter bodies to purge oil from the system through the hydraulic control valve.

Referring now to FIG. 4 of the drawings, numeral 56 generally indicates a cylinder deactivation apparatus which is generally similar to FIG. 2 and wherein like numerals indicate like parts. Apparatus 56 differs in that the deactivating devices are stationary hydraulic lash adjusters 58 which are fixedly mounted in a lash adjuster gallery 60. The remainder of the apparatus 56 is identical to and operates in the same manner as the apparatus 46 of FIG. 2 so that like numerals are used for like parts. FIG. 5 shows an enlarged pictorial view of a stationary lash adjuster 58, showing the connection of an annular feed groove 22 with the pin feed opening 54 through restricted bypass groove 48 as in the hydraulic valve lifter body of FIG. 3.

Since the embodiment of FIGS. 4 and 5 operates in a manner identical to that of FIGS. 2 and 3, except for the use of stationary hydraulic lash adjusters, further description of the embodiment of FIGS. 4 and 5 is believed unnecessary.

Figure 6:
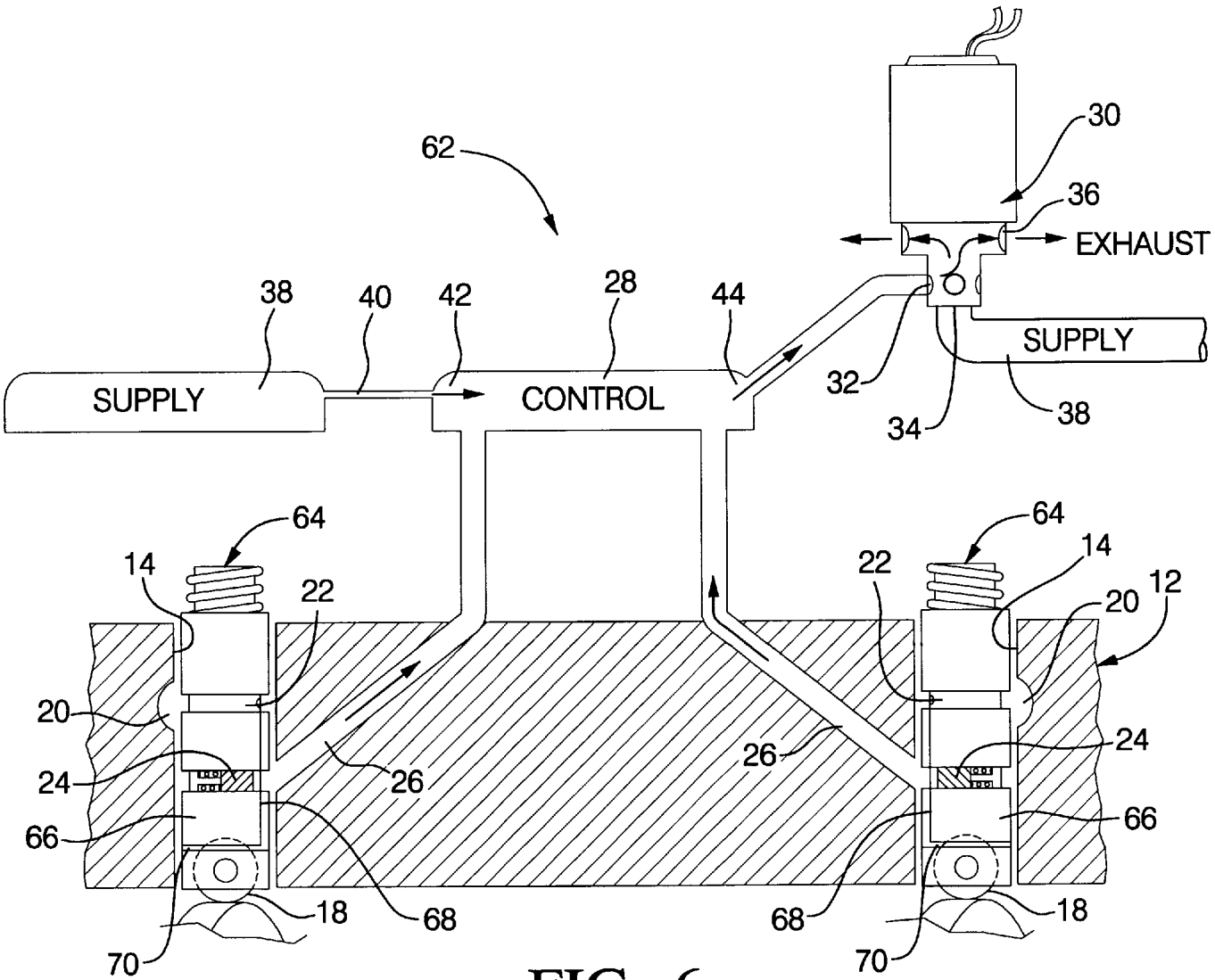
FIG. 6 is a view similar to FIG. 1 showing an alternative embodiment including a valve lifter with a lower hydraulic seal groove fed by a vertical groove from the oil gallery.

FIG. 6 of the drawings shows an alternative cylinder deactivation apparatus 62 that is a variation of the embodiment of FIG. 1 and in which like numerals indicate like parts. Apparatus 62 includes modified switching valve lifters 64. Each lifter 64 includes a lifter body 66 having a vertical channel 68 extending from the lifter oil gallery 20 to an annular channel 70 circumscribing a lower portion of the body 66. Pressurized oil in the annular channel 70 acts as a fluid seal against the wall of the lifter gallery bore 14 to prevent the entry of air bubbles from below the lifter gallery 12 entering the bore 14 and passing into the control channel 26. The seal prevents aeration of the control channel oil, which can interfere with the timing of the deactivation process during engine operation.

Figure 7:
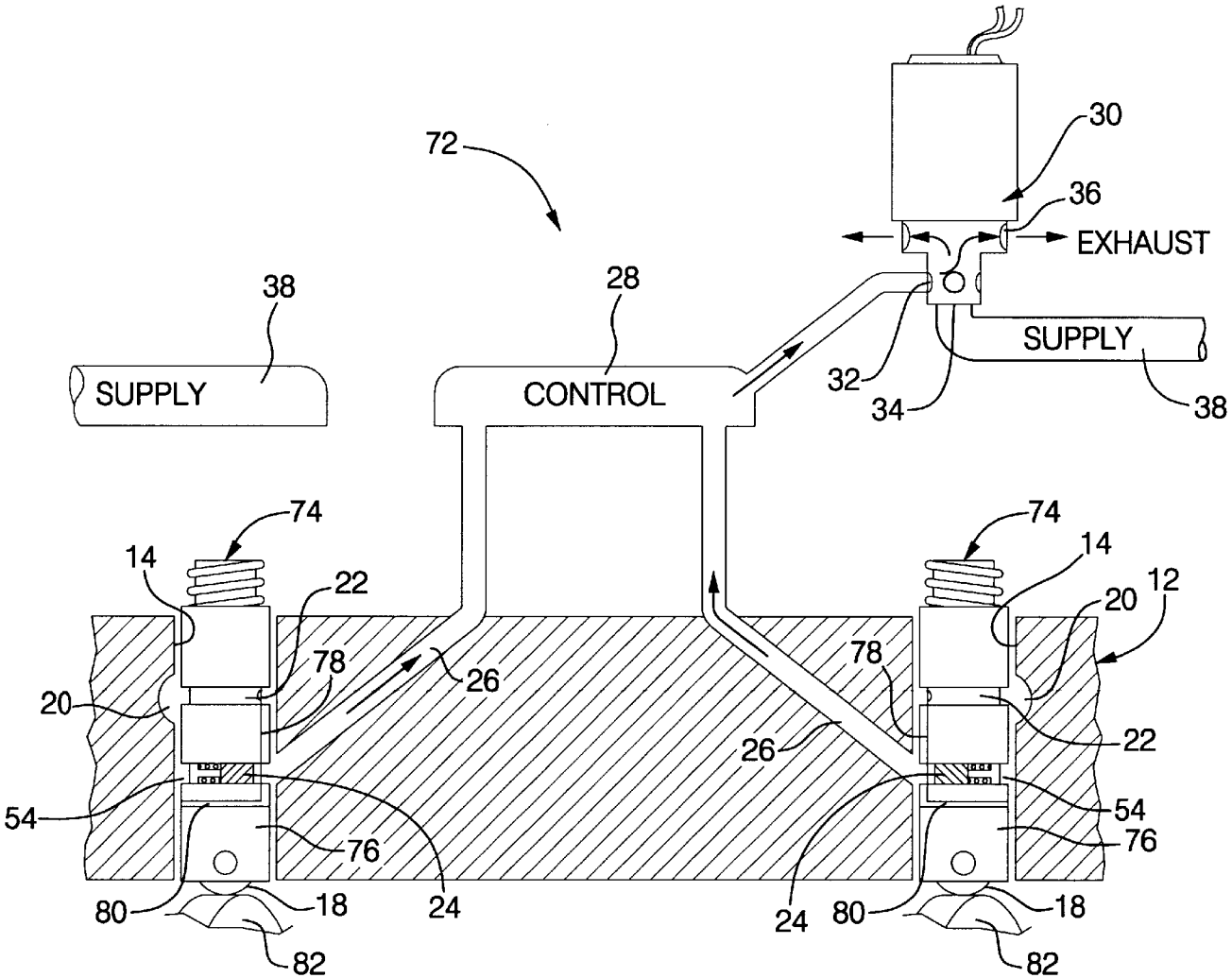
FIG. 7 is a view similar to FIG. 6 wherein the seal groove is raised to act as an air purge bypass during actuation of the lifter.
Figure 8:
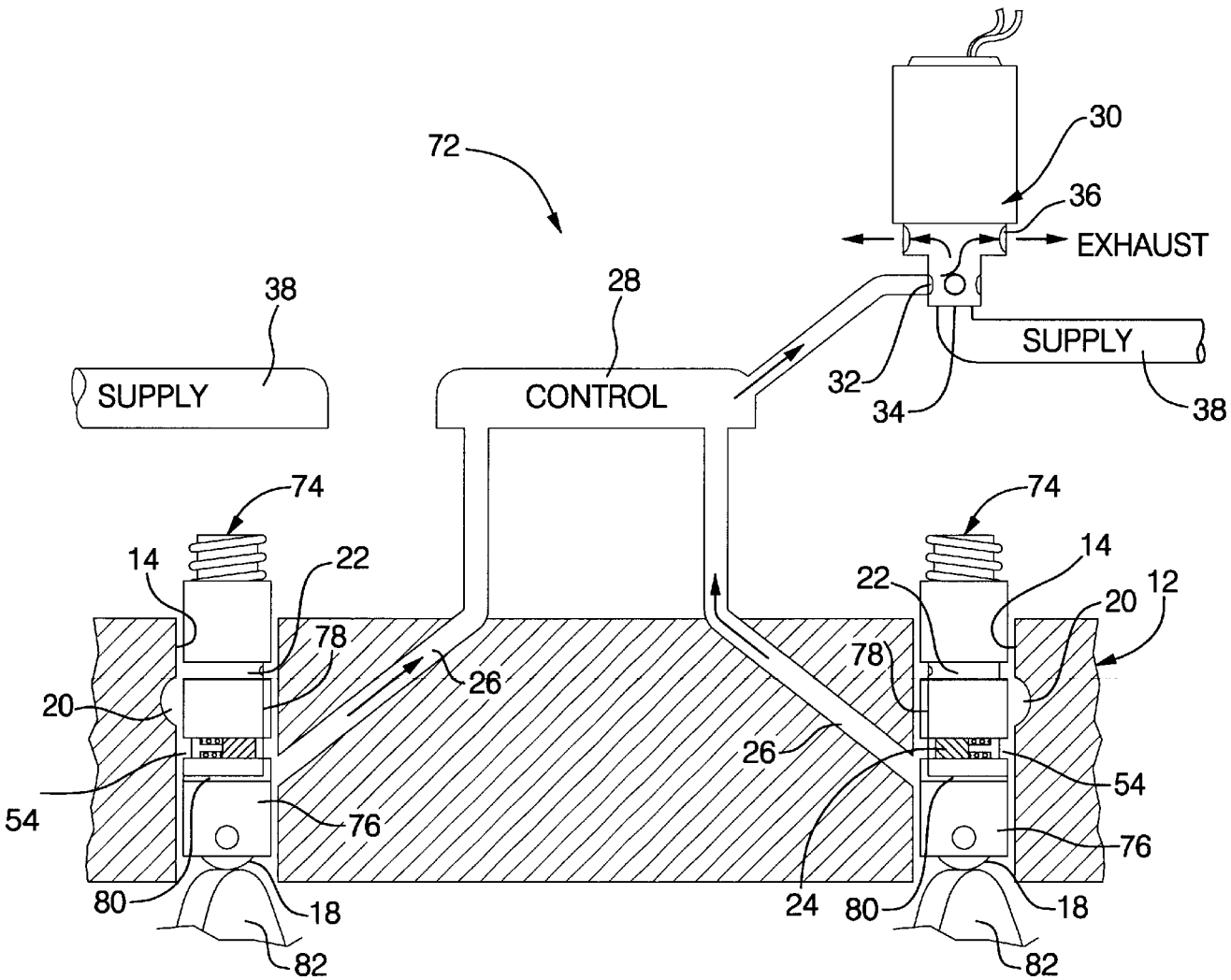
FIG. 8 is a view similar to FIG. 7 showing the lifter in an actuated position wherein air purge oil flow occurs.

FIGS. 7 and 8 illustrate a cylinder deactivation apparatus 72 that is a variation of the embodiment of FIG. 2 wherein like numerals indicate like parts. This variation also includes modified switching valve lifters 74. Each lifter 74 includes a lifter body 76 having a vertical channel 78 extending from the lifter oil gallery 20 to an annular channel 80 circumscribing a portion of the body 76 slightly below the pin feed openings 54. Pressurized oil in; the annular channel 80 again acts as a fluid seal against the wall of the,lifter gallery bore 14 to prevent the entry of air bubbles from below the lifter gallery 12 entering the bore 14 and passing into the control channel 26. The seal prevents aeration of the control channel oil, which can interfere with the timing of the deactivation process during engine operation.

The upward relocation of the annular channel 80 allows the channel 80 to supplement the function of purging air from the control channels during engine operation. FIG. 7 shows the operating condition when the lifter actuating cam 82 is on the base circle and the associated valve is closed. The annular channel 80 is then located below the control passage 26 so that channel 80 acts as a seal, preventing air entry from below into the control channel 26. FIG. 8 shows the condition when the cam 82 raises the lifter 74 to its maximum lift. Annular channel 80 is then aligned with the control passage 26 to provide oil flow from the oil gallery 12 through the vertical channel 78 and annular channel 80 to the control passage 26. The oil flow purges the control channel 26 from aerated oil which is carried out through the control valve exhaust 36 and returned to the engine oil pan, not shown. When the cam again returns to the base circle, the annular channel continues to form a fluid seal, preventing the admission of air to the oil from below.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. Apparatus for selectively deactivating specified cylinders of an engine, said apparatus comprising:

switchable hydraulic lash adjusters forming part of a valve train for actuating engine valves of the specified cylinders and operative to selectively actuate or release their respective valves in response to an increase or decrease of oil pressure supplied to switching portions of the lash adjusters;

a gallery carrying said lash adjusters and including oil passages connecting with the switching portions;

a pressure oil supply connected with said oil passages for providing pressure oil to the switching portions of the lash adjusters;

a three-way valve connected with the pressure oil supply and operative to close or open communication of the oil supply with said passages, the valve having an exhaust port alternately connectable with said passages to relieve oil pressure in the passages when communication with the pressure oil supply is closed; and a bypass between the pressure oil supply and said oil passages, the bypass carrying oil to at least portions of the oil passages to purge air from said passage portions when the three-way valve exhaust port is open.

2. Apparatus as in claim 1 wherein the bypass is a restricted passage connecting the pressure oil supply with a control channel joining the oil passages.

3. Apparatus as in claim 1 wherein said bypass comprises a restricted bleed path at each of the switchable lash adjusters and connecting a pressure oil supply to each of said lash adjusters with the passages connecting with the switching portions of said lash adjusters.

4. Apparatus as in claim 3 wherein said restricted bleed paths are formed in the respective lash adjusters.

5. Apparatus as in claim 4 wherein said restricted bleed paths comprise grooves in a body portion of each of the switchable lash adjusters, each groove extending between a pressure feed opening and a lock pin of the respective lash adjuster.

6. Apparatus as in claim 1 wherein the lash adjusters are stationary self-contained units adapted for use with an overhead camshaft.

7. Apparatus as in claim 1 wherein the lash adjusters are contained in valve lifters reciprocable with the valve train for actuating the engine valves.

8. Apparatus as in claim 5 wherein the lash adjusters are contained in valve lifters reciprocable with the valve train and each of said grooves extends to an annular channel disposed below the lock pin in the body of the respective last adjuster to provide a pressure oil seal that prevents air from below the lash adjuster gallery from entering the associated oil supply passage in the gallery.

9. Apparatus as in claim 8 wherein each annular channel is positioned on the lash adjuster body so as to communicate with the associated pressure oil supply passage when the lash adjuster is raised to open an associated valve but to lie below the supply passage when the lash adjuster is lowered to the valve closed position.

* * * * *